United States Patent [19]

Wachi

[11] Patent Number: 4,765,153

[45] Date of Patent: Aug. 23, 1988

[54] CRYOSTAT WITH RADIATION SHIELDS COOLED BY REFRIGERATOR

[75] Inventor: Yoshihiro Wachi, Yokohama, Japan

[73] Assignee: Kabushiki Kaisha Toshiba, Kawasaki, Japan

[21] Appl. No.: 12,265

[22] Filed: Feb. 9, 1987

[30] Foreign Application Priority Data

Feb. 12, 1986 [JP] Japan ..... 61-26753

[51] Int. Cl.[4] ..... F25B 19/00

[52] U.S. Cl. ..... 62/514 R; 62/383

[58] Field of Search ..... 62/383, 514 R

[56] References Cited

U.S. PATENT DOCUMENTS

| | | | |
|---|---|---|---|
| 3,609,992 | 10/1971 | Cacheux | 62/514 R |
| 3,611,746 | 10/1971 | Marsing et al. | 62/514 R |
| 4,218,892 | 8/1980 | Stephens | 62/514 R |
| 4,279,127 | 7/1981 | Longsworth | 62/514 R |
| 4,484,458 | 11/1984 | Longsworth | 62/514 JT |
| 4,535,595 | 8/1985 | Keller et al. | 62/514 R |
| 4,543,794 | 10/1985 | Matsutani et al. | 62/514 R |

FOREIGN PATENT DOCUMENTS

| | | |
|---|---|---|
| 59-32758 | 2/1984 | Japan . |
| 60-69540 | 4/1985 | Japan . |

*Primary Examiner*—Ronald C. Capossela

*Attorney, Agent, or Firm*—Foley & Lardner, Schwartz, Jeffery, Schwaab, Mack, Blumenthal & Evans

[57] ABSTRACT

A cryostat with two radiation shields cooled by a two stage helium refrigerator which can be easily and quickly removed for maintenance. The inner radiation shield is thermally connected with the second stage of the refrigerator by gaseous convection, while the outer radiation shield is connected with the first stage by metal-to-metal surface contact. The refrigerator is removably installed in a gas-tight receptacle, which forms an annular region around the refrigerator.

5 Claims, 2 Drawing Sheets

CRYOSTAT WITH RADIATION SHIELDS COOLED BY REFRIGERATOR

BACKGROUND OF THE INVENTION

This invention relates to a cryostat which contains cryogenic liquid such as liquid helium with a double radiation shield cooled by a refrigerator.

A cryostat with a double radiation shield cooled by a two stage refrigerator for minimizing the evaporation rate of the cryogenic liquid is disclosed in the Japanese Patent Disclosure (Kokai) No. 60-69540. The first stage of the refrigerator operated at a temperature of about 80 degrees K. has thermal contact with the outer radiation shield, while the second stage operated at about 20 degrees K. has contact with the inner radiation shield. Such a refrigerator requires removal from the cryostat once in a while for maintenance and/or replacement.

The refrigerator shown in the Japanese patent disclosure has two metal-to-metal surface contact portions, one at the first stage and the other at the second stage. With such a construction, it is difficult to obtain sufficient thermal contacts simultaneously at the two contact portions, and the removal and the re-installation of the refrigerator is a time-consuming job. Furthermore, the entire cryostat must be warmed to room temperature before the refrigerator is removed so that the humidity in the air can not condense and freeze on the radiation shields and on the contact portions. Consequently, the refrigerator removal and reinstallation operation consumes an extensive amount of liquid helium, as well as taking a long time.

SUMMARY OF THE INVENTION

The object of this invention is to provide a cryostat with radiation shields cooled by a refrigerator which can be easily and quickly removed for maintenance.

According to one aspect of the invention there is provided a cryostat comprising: a reservoir for holding cryogenic liquid; double radiation shields, each of which surrounds the reservoir; a vacuum vessel surrounding the double radiation shields; and a refrigerator removably mounted on the vacuum vessel and having two different temperature heat stages, wherein one of the radiation shields is in thermal contact with one of the heat stages by metal-to-metal surface contact, and the other of the radiation shields is in thermal contact with the other one of the heat stages by gaseous convection.

According to another aspect of the invention, there is provided a cryostat comprising: a reservoir for holding cryogenic liquid; double radiation shields, each of which surrounds the reservoir; a vacuum vessel surrounding the double radiation shields; and a refrigerator removably mounted on the vacuum vessel and having two different temperature heat stages, one of which is in thermal contact with one of the radiation shields, while the other of which is in thermal contact with the other radiation shield; a receptacle covering the heat stages gas-tightly; means for introducing uncondensible gas into the receptacle; and means for evacuating gas from the receptacle.

BRIEF DESCRIPTION OF THE DRAWINGS

The invention will be described in further detail with reference to the accompanying drawings, wherein.

DETAILED DESCRIPTION OF THE PREFERRED EMBODIMENTS

Figure 1:
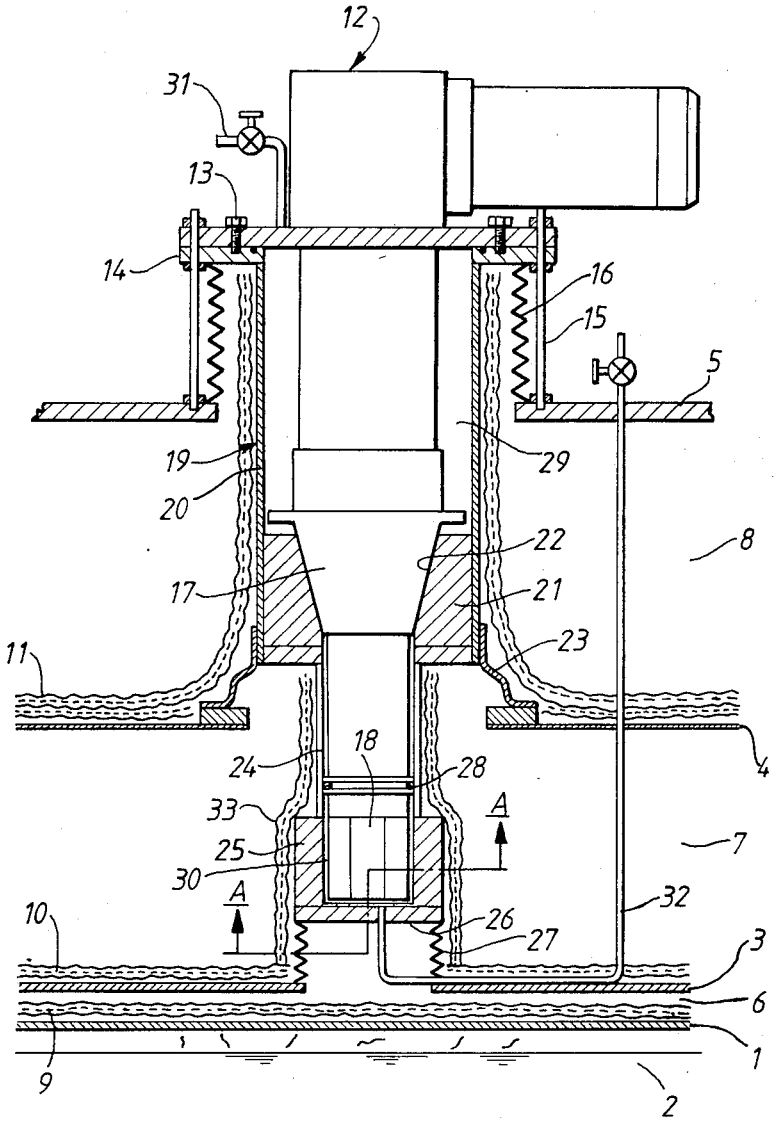
FIG. 1 is a fragmentary cross-sectional view of the essential part of the cryostat according to the present invention.

Referring to FIG. 1, reference numeral 1 designates a reservoir which contains cryogenic liquid such as liquid helium 2. The reservoir 1 is surrounded by an inner radiation shield 3, which in turn is surrounded by an outer radiation shield 4. The double shielded reservoir 1 is surrounded by a vacuum vessel 5, which forms vacuum layers 6, 7 and 8, covering the reservoir 1 and the radiation shields 3 and 4, respectively. The reservoir 1 and the radiation shields 3 and 4 are further covered by multiple insulation layers 9, 10 and 11, respectively.

A two stage refrigerator such as a displacer-expander refrigerator 12 is mounted with bolts 13 on a flange 14 which is adjustably supported on the vacuum vessel 5 with stud bolts 15.

The gap between the flange 14 and the vacuum vessel 5 is flexibly sealed with a bellows 16. The refrigerator 12 has a first heat stage 17 and a second heat stage 18, which are positioned within the vacuum vessel 5. The flange 14 holds and is connected with a receptacle 19 which surrounds the first and the second heat stages 17 and 18.

The upper part of the receptacle 19 has an upper cylinder body 20 which surrounds the first heat stage 17 and a contact block 21 which is fixed in the upper cylinder body 20. The contact block 21 is made of high thermal-conductivity material, such as copper, and has a tapered hole 22. The first heat stage 17 of the refrigerator 12 is tapered to fit the tapered hole 22. The tapered contact surfaces of the refrigerator 12 and/or the contact block 21 are coated with an indium foil. The lower part of the upper cylinder body 20 is thermally connected with the outer radiation shield 4 by flexible metal wires 23.

The lower part of the receptacle 19 has a lower cylinder body 24 which is suspended from the contact block 21 and which surrounds the second heat stage 18. A non-contact block 25, the bottom of which is sealed with a bottom plate 26, is suspended by the lower cylinder body 24. The bottom plate 26 is thermally connected with the inner radiation shield 3 by a bellows 27. The non-contact block 25, the bottom plate 26 and the bellows 27 are made of high thermal-conductivity metal, such as copper.

A polytetrafluoroethylene (i.e., Teflon TM) ring 28 is mounted between the first and the second stages 17 and 18 on the refrigerator 12. The ring 28 fits the inner surface of the lower cylinder body 24 and divides the annular region surrounding the refrigerator 12 in the receptacle 19 into an upper annular region 29 and a lower annular region 30.

The upper annular region 29 is connected with a conduit 31, which leads to a vacuum pump (not shown) and to a supply of uncondensible gas, such as a cylinder of helium gas (not shown). The lower annular region 30 is connected with a conduit 32 which leads to a supply of uncondensible gas (not shown).

The receptacle 19 is covered with a multilayer thermal insulation 33.

Figure 2:
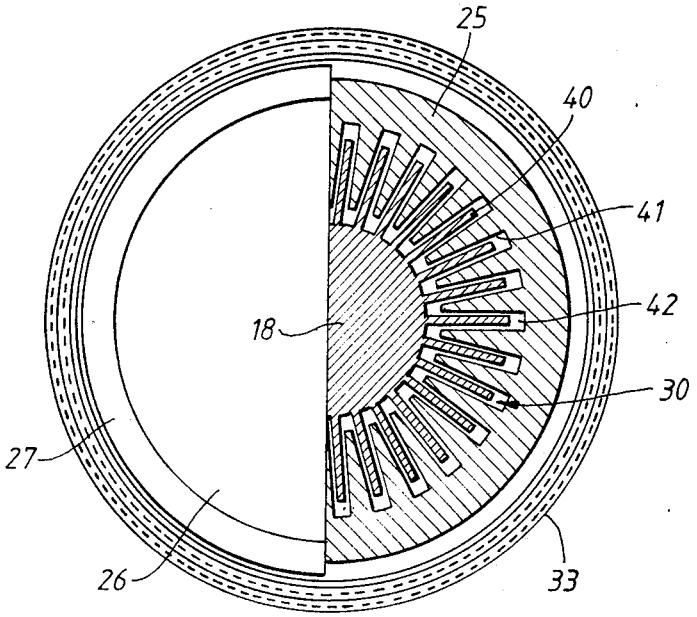
FIG. 2 is a partial cross-sectional view taken along line A—A of FIG. 1.

Referring to FIG. 2, the second heat stage 18 has fins 40 of high thermal-conductivity material which extend axially and radially. The non-contact block 25 is provided with corresponding grooves 41 in which the fins 40 are received with a gap 42 therebetween which constitutes part of the lower annular region 30 shown in FIG. 1.

The operation of that cryostat is described below. In normal operational condition, the upper annular region 29 is in vacuum, while the lower annular region 30 is filled with an uncondensible gas such as helium gas. The inner radiation shield 3 is kept at about 20 degrees K. as it is in thermal contact with the second heat stage 18 through the uncondensible gas convection in the gap 42. The heat transfer area in the gap 42 is enlarged by the fins 40 and the grooves 41.

The outer radiation shield 4 is kept at about 80 degrees K. as it is in thermal contact with the first heat stage 17 through the metal-to-metal surface contact between the first heat stage 17 and the contact block 21. Since the contact surface is tapered, the contact pressure is increased by the weight of the refrigerator 12 and by the fastening force of the bolts 13. Furthermore, the indium coating on the first heat stage 17 and/or on the tapered hole 22 enhances the metal-to-metal surface contact.

Because the upper annular region 29 is under vacuum, heat leakage is minimized.

When the refrigerator 12 requires maintenance or renewal, the operation of the refrigerator is first stopped, Then, uncondensible gas is introduced into the upper annular region 29 through the conduit 31, and the refrigerator 12 is lifted and removed from the receptacle 19. Because the uncondensible gas fills the receptacle 19, humidity in the air cannot enter the receptacle 19 and contact portions are prevented. Therefore, the refrigerator 12 can be re-installed after the repair, or a new refrigerator can be installed without delay. Since only the first stage has mechanical contact, and the second stage does not, the positioning of the refrigerator 12 is easy. After the re-installation of the refrigerator 12, the refrigerator 12 is put into operation, and the gas in the upper annular region 29 is evacuated through conduit 31.

Since the removal and the re-installation operation takes only a short time, the amount of liquid helium 2 evaporated from reservoir 1 during the maintenance or replacement of the refrigerator is minimized.

Besides the embodiment described above, it is equally feasible to provide a device in which the thermal contact at the first stage is by gaseous convection and the thermal contact at the second stage is by metal-to-metal surface contact.

The foregoing description has been set forth merely to illustrate preferred embodiments of the invention and is not intended to be limiting. Since modifications of the described embodiments incorporating the spirit and substance of the invention may occur to persons skilled in the art, the scope of the invention should be limited solely with respect to the appended claims and equivalents.

What is claimed is:

1. A cryostat comprising:

(a) a reservoir for holding cryogenic liquid;

(b) double radiation shields, each of which surrounds said reservoir;

(c) a vacuum vessel surrounding said double radiation shields;

(d) a refrigerator removably mounted on said vacuum vessel, having two different temperature heat stages, one of which is in thermal contact with one of the radiation shields, while the other of which is in thermal contact with the other radiation shield;

(e) a receptacle covering said refrigerator heat stages gas-tightly;

(f) means for introducing uncondensible gas into said receptacle; and (g) means for evacuating gas from said receptacle.

2. A cryostat comprising:

(a) a reservoir for holding cryogenic liquid;

(b) double radiation shields, each of which surrounds said reservoir, one of the shields comprising a contact block of high thermal-conductivity having a tapered hole;

(c) a vacuum vessel surrounding said double radiation shields; and (d) a refrigerator removably mounted on the vacuum vessel, having two different temperature heat stages, wherein one of said heat stages is tapered so as to fit in said tapered hole and to obtain metal-to-metal surface contact with the contact block, and the other of said heat stages is in thermal contact with the other of said shields by gaseous convection.

3. A cryostat according to claim 1, wherein the tapered heat stage is coated wtih an indium foil.

4. A cryostat according to claim 1, wherein the tapered hole in the contact block is coated with an indium foil.

5. A cryostat comprising:

(a) a reservoir for holding cryogenic liquid;

(b) double radiation shields each of which surrounds said reservoir, one of the shields comprising a non-contact block of high thermal-conductivity;

(c) a vacuum vessel surrounding said double radiation shields;

(d) a refrigerator removably mounted on the vacuum vessel, having two different temperature heat stages, wherein one of the heat stages comprises fins of high thermal-conductivity facing said non-contact block across a gap, and the other of the heat stages is in thermal contact with the other of the shields by metal-to-metal surface contact; and (e) means for introducing uncondensible gas into the gap between said fins and said non-contact block.

* * * * *